United States Patent [19]

Wright

[11] Patent Number: 5,037,329

[45] Date of Patent: Aug. 6, 1991

[54] ANGULAR CONNECTOR FOR A SHIELDED COAXIAL CABLE

[75] Inventor: John O. Wright, York, Pa.

[73] Assignee: GTE Products Corporation, Stamford, Conn.

[21] Appl. No.: 588,780

[22] Filed: Sep. 27, 1990

[51] Int. Cl.[5] ..... H01R 13/00

[52] U.S. Cl. ..... 439/582

[58] Field of Search ..... 439/578–585, 439/444, 741

[56] References Cited

U.S. PATENT DOCUMENTS 3,047,828 7/1962 Gregson et al. ..... 439/582

4,360,244 11/1982 Forney, Jr. et al. ..... 439/582

*Primary Examiner*—Joseph H. McGlynn

*Attorney, Agent, or Firm*—William H. McNeill

[57] ABSTRACT

An angular connector for use in effecting a solderless electrical and mechanical angular connection to a shielded coaxial cable including retaining tabs which extend from a ferrule and engage a bushing to mechanically connect the ferrule to a connector housing, and camming tabs which urge opposing ferrule fingers toward each other to electrically and mechanically connect the ferrule to an inner cable lead such as a signal lead of the cable.

28 Claims, 3 Drawing Sheets

ANGULAR CONNECTOR FOR A SHIELDED COAXIAL CABLE

BACKGROUND OF THE INVENTION

1. Field of the Invention

The present invention relates to an angular connector for attachment to the end of a shielded coaxial cable for use, for example, in effecting an audio antenna connection.

2. Description of the Prior Art

Heretofore, fabrication of the typical angular audio antenna connector/coaxial cable assembly has been by hand. In fabricating such an assembly, the inner lead of the cable, which serves as the signal wire, has been soldered to a female lug or male pin of the connector. Typically, to effect the angular connection, subsequent to the joining of the connector/cable assembly, the cable has been turned through an angle and clamped in place. For example, FIG. 1 depicts one known typical female audio antenna connector. Such connector includes a coaxial cable 2 having an end 4 which has been stripped in a known manner such that the signal wire 6 and the signal wire insulator 8 extend from the end 4. The usual shield layer 10 is folded back upon the cable 2. The signal wire insulator 8 is disposed within a plastic sleeve 12 which is disposed within a plastic bushing 14. Bushing 14 is held in place within an outer metal shell 16 by means of a flanged portion 18 of the outer metal shell and an inner metal shell 20 force fit between the shield layer 10 and outer shell 16 and in abutment with the plastic bushing 14 at 22. The electrical connection is completed by soldering the signal wire 6 to a lug 24 at 26. Subsequent to such assembly the cable 2 is turned through a right angle to the position shown in phantom lines at 2'. During use, the connector is held in place by means of retention fingers 28. It will be apparent to those skilled in the art that fabrication of such a connector involves several parts and several distinct steps including the application of solder to effect an electrical connection. The use of such a solder connection typically requires hand assembly which adds to the cost of fabrication. The retention fingers 28 also provide less than desirable retention in the socket of, for example, a radio.

It is desired to provide an angular connector for electrical connection to a coaxial cable for use, for example, in effecting an audio antenna connection, which includes a reduced number of parts and fabrication steps. It is further desirable to provide such a connector which does not require the use of solder in effecting an electrical connection between cable and connector. It is also desirable to provide such a connector which is automatable, the need for hand assembly being eliminated. It is further desired to provide such a connector having improved retention in a socket. It is also desirable to provide such a connector which can be manufactured at reduced costs. It is further desired to provide such a connector wherein upon assembly with a cable it is not necessary to turn the cable through an angle to obtain the angular connection.

SUMMARY OF THE INVENTION

This invention achieves these and other results by providing a shielded coaxial cable having a connector mechanically and electrically attached thereto, comprising a metal connector housing having a first elongated portion extending along a first longitudinal axis and a second elongated portion extending along a second longitudinal axis which is disposed at an angle relative to the first longitudinal axis. A plastic bushing is provided which is internal of the first elongated portion and attached to the housing. Such bushing includes a first longitudinal bore extending along the first longitudinal axis and a second longitudinal bore extending along the second longitudinal axis, the first longitudinal bore extending to the second longitudinal bore. A shielded coaxial cable is provided having an end extending into the second elongated portion. An exposed length of an inner lead and an exposed length of an inner lead insulator extend from such cable end along the second longitudinal axis and into the second longitudinal bore. Such end includes a shield layer folded back upon an outer surface of the shielded coaxial cable between the outer surface and an inner surface of the second elongated portion. A tubular ferrule is also provided. Such ferrule includes a first portion which extends into the first longitudinal bore and includes at least two camming tabs which are biased away from the first longitudinal axis against an inner bore wall of the longitudinal bore, and a second portion which extends into the second longitudinal bore and includes at least two fingers which are biased toward the second longitudinal axis against an outer surface of the inner lead. The present invention provides for a connector per se as well as a combination shielded coaxial cable having such a connector electrically and mechanically attached thereto.

BRIEF DESCRIPTION OF THE DRAWINGS

This invention may be clearly understood by reference to the attached drawings in which.

DESCRIPTION OF THE PREFERRED EMBODIMENT

Figure 2:
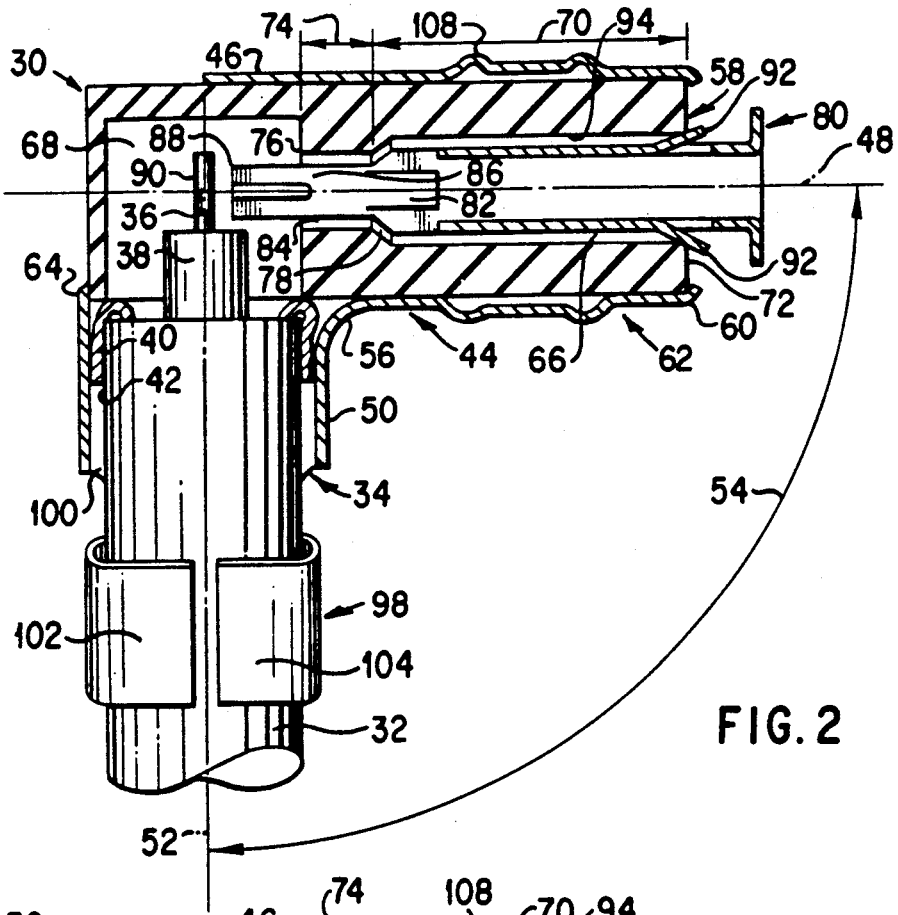
FIG. 2 is a view of an angular connector of the present invention during assembly thereof.
Figure 3:
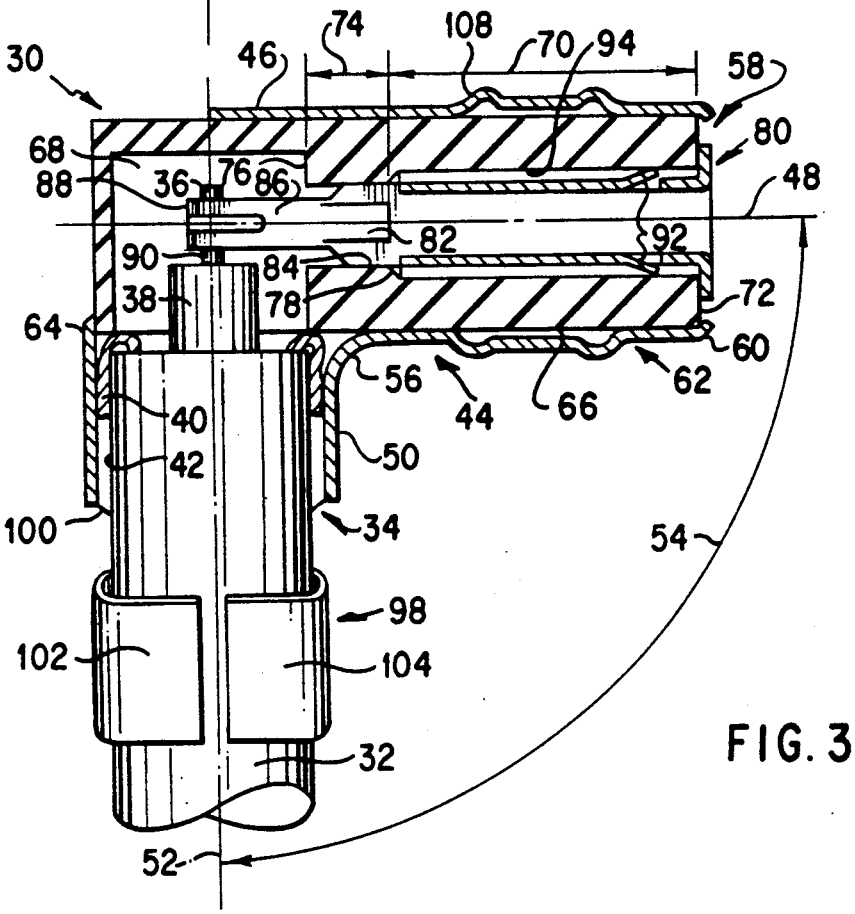
FIG. 3 is a view of the angular connector of FIG. 2 subsequent to assembly.

The embodiment which is illustrated in the drawings is one which is particularly suited for achieving the objects of this invention. FIGS. 2 and 3 depict a connector 30 for electrical and mechanical connection to a typical shielded coaxial cable 32 which has an end portion 34 including an exposed length of an inner lead 36 and an exposed length of an inner lead insulator 38 extending from end portion 34. When used to effect an audio antenna connection, the inner lead 36 provides a signal wire in a known manner. A typical shield layer 40 is folded back upon an outer surface 42 of the cable 32. Shielded coaxial cable 32 can be any known shielded coaxial cable useful, for example, in connecting an antenna to a radio or any other antenna application. The connector of the present invention is believed to be particularly useful with a shielded coaxial cable for use in connecting an automobile antenna to an automobile radio.

The connector 30 includes a metal connector housing 44 having a first elongated portion 46 extending along a first longitudinal axis 48 and a second elongated portion 50 extending along a second longitudinal axis 52 which is disposed at an angle 54 relative to the first longitudinal axis 48. In the preferred embodiment connector 30 is a right angle connector and angle 54 is 90°. Also, in the preferred embodiment, housing 44 is fabricated from a metal such as, without limitation, brass or a copper alloy, the first and second elongated portions 46 and 50 respectively, being tubular and connected together at an integral bridging portion 56.

A bushing 58 fabricated from plastic such as, without limitation PBT (Polybutylene Terephthalate), may also be made from a thermoset material, such as Phenolic, is provided internal of the first elongated portion 46 and attached to the housing 44. For example, the housing 44 can be provided with a flanged end portion 60 at end 62 of the first elongated portion 46 as depicted in the drawings. In such an embodiment, the bushing 58 is attached to housing 44 by being held in place between the flanged end portion 60 and an extension 64 of the second elongated portion 50 of the housing. Bushing 58 includes a first longitudinal bore 66 which extends along axis 48 and a second longitudinal bore 68 which extends along axis 52. The first longitudinal bore 66 extends to the second longitudinal bore 68, bore 66 being an axial bore and bore 68 being a radial bore as depicted in FIGS. 2 and 3. In the preferred embodiment, the first longitudinal bore 66 includes a first bore length 70 adjacent a first end 72 of bore 66 and a second bore length 74 adjacent an opposite second end 76 of bore 66. The first bore length 70 has a diameter which is greater than the diameter of the second bore length 74 to form a camming surface 78 adjacent the second bore length 74.

Figure 5B:
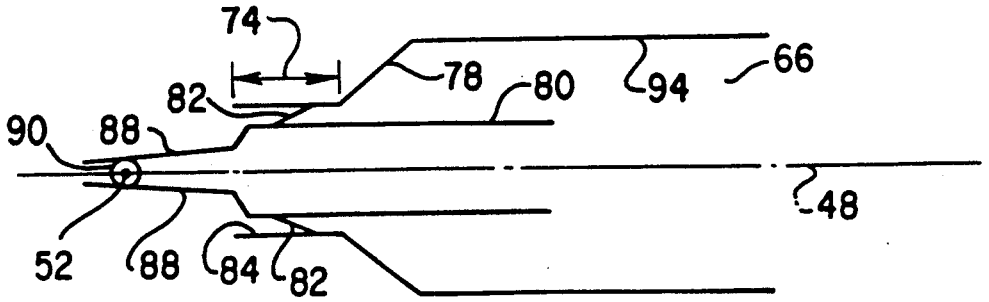
FIG. 5B is a schematic view of the elements of FIG. 5A.
Figure 5A:
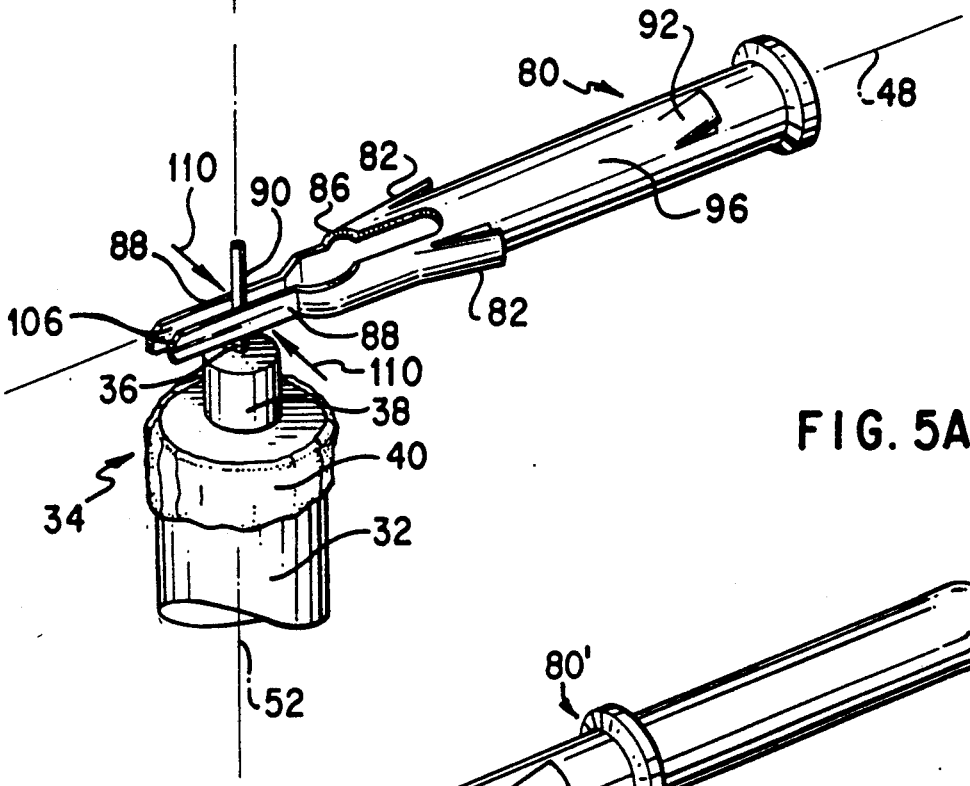
FIG. 5A is an elevational view of some of the components of FIG. 3.
Figure 6:
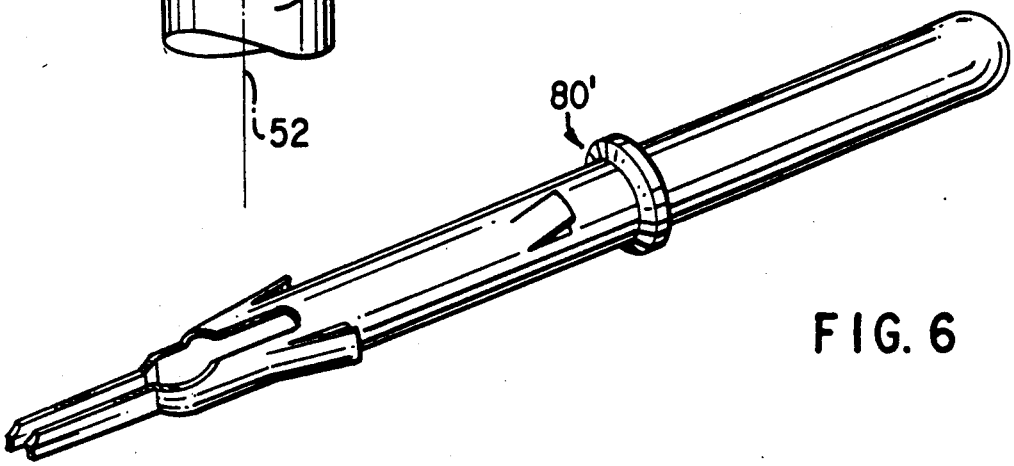
FIG. 6 is a view of a male ferrule of the present invention.

Connector 30 also includes a metal tubular ferrule 80. In the embodiment of FIGS. 2 to 5, ferrule 80 is a female ferrule. FIG. 6 depicts a male ferrule 80' which is structurally and functionally identical to ferrule 80 with the exception that ferrule 80 provides a female connection and ferrule 80' provides a male connection. Ferrule 80 includes a first portion for insertion into the first longitudinal bore 66 when connecting the cable 32 to the connector 30 as described herein. The first portion includes at least two camming tabs 82 which are biased away from the first longitudinal axis 48 against an inner wall of bore 66 during such insertion. In the preferred embodiment, tabs 82 are biased away from axis 48 against an inner bore wall 84 of the second bore length 74 of bore 66 when the ferrule is positioned as depicted in FIG. 3. Ferrule 80 also includes a second portion 86 for insertion into the second longitudinal bore 68 when connecting the cable 32 to the connector 30 as described herein. The second portion 86 includes at least two fingers 88 which are biased toward the second longitudinal axis 52 against an outer surface 90 of inner lead 36 during such insertion as depicted in FIGS. 3 and 5. Fingers 88 provide a mechanical and electrical connection between the ferrule 80 and the inner lead 36. In the preferred embodiment, ferrule 80 also includes at least two retaining tabs 92 which are biased away from the first longitudinal axis 48 against an inner bore wall of the first longitudinal bore 66 during insertion of the first portion 82 of ferrule 80 into bore 66. In the preferred embodiment, tabs 92 are biased away from axis 48 against an inner bore wall 94 of the first bore length 70 of bore 66 as depicted in FIG. 3. Retaining tabs 92 provide a mechanical connection between the ferrule 80 and bushing 58. In the preferred embodiment there are two camming tabs 82 and two corresponding fingers 88 circumferentially spaced 180° as depicted in FIG. 4. Similarly, there are two retaining tabs 92, offset circumferentially 90° relative to the camming tabs 82 and fingers 88, and circumferentially spaced 180°, as depicted in FIGS. 2 and 3. It will be apparent to those skilled in the art that any number of such tabs and fingers can be used.

In the preferred embodiment, each camming tab 82, finger 88, and retaining tab 92 is integral with the metal ferrule 80 as depicted in FIGS. 2 to 5. In the preferred embodiment, ferrule 80 is fabricated from phosphor bronze, or other alloys which provides a natural bias or resiliency in tabs 82 and 92 when such tabs are stamped or otherwise angularly oriented relative to an outer surface 96 of the ferrule. In the preferred embodiment depicted in FIG. 4 each retaining tab 92 protrudes at an angle A away from an axis of the tubular ferrule 80, which axis, upon insertion as depicted in FIGS. 2 and 3 is coincident with longitudinal axis 48 and away from fingers 88 of ferrule 80. Similarly, each camming tab 82 depicted in FIG. 4 protrudes at an angle B away from such ferrule axis and away from fingers 88 of the ferrule. In the preferred embodiment, angle A is about 15° and angle B is about 15°. In the drawings, angles A and B are depicted relative to surface 96 which is parallel to the axis of the ferrule.

In the preferred embodiment, the second elongated portion 50 of the housing 44 includes a strain relief member 98 extending therefrom for attachment to the cable 32. Strain relief member 98 is preferably integral with housing 44, extends therefrom at neck portion 100, and includes two wings 102, 104 which can be wrapped about cable 32 as depicted in FIGS. 2 and 3 to provide integral strain relief for the cable vis-a-vis the connector.

In order to enhance the connection between the inner lead 36 and fingers 88, each finger preferably includes an elongated protuberance or rib 106. During insertion of the ferrule 80 into the plastic bushing 58 as described herein, the elongated protuberances 106 will be biased or urged toward the second longitudinal axis 52 against the outer surface 90 of the inner lead 36.

In the preferred embodiment, the metal housing 44 also includes at least one ribbed portion 108 expanded away from an outer surface of the housing to provide a retention means which effects improved retention when the connector 30 is inserted into, for example, a typical antenna socket of a radio. It will be apparent to those skilled in the art that any number of such ribbed portions can be provided. In the embodiment depicted in the drawings there are four ribbed portions circumferentially equally spaced, only two being depicted in FIGS. 2 and 3.

In assembling the device described herein, an end 34 of coaxial cable 32 is stripped in a known manner to provide an exposed length of inner lead 36 and an exposed length of inner lead insulator 38. Then the shield layer 40 is folded back upon the outer surface 42 of cable 32. Such cable end is inserted into the second elongated portion 50 of the metal connector housing 44 until the inner lead insulator 38 enters the second longitudinal bore 68 as depicted in FIGS. 2 and 3. During such insertion, the shield layer 40 will be sandwiched between the outer cable surface 42 and an inner surface of the second longitudinal portion 50 effecting electrical contact between the shield layer and the housing. The a male or female ferrule (80, 80') is inserted into the first elongated portion 46 of the housing 44.

Figure 1:
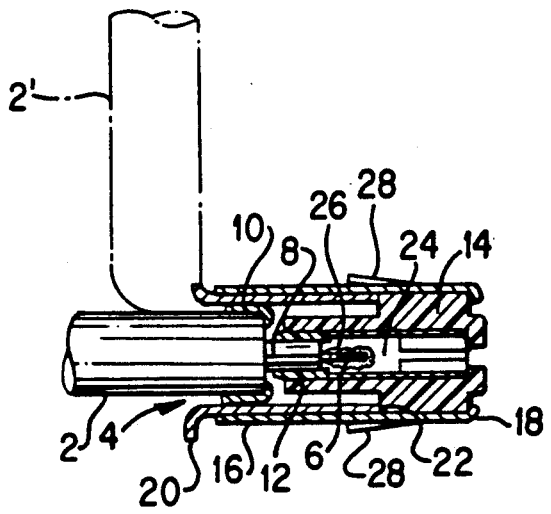
FIG. 1 PRIOR ART
FIG. 1 is a view of a prior art right angle audio antenna connector/coaxial cable assembly.
Figure 4B:
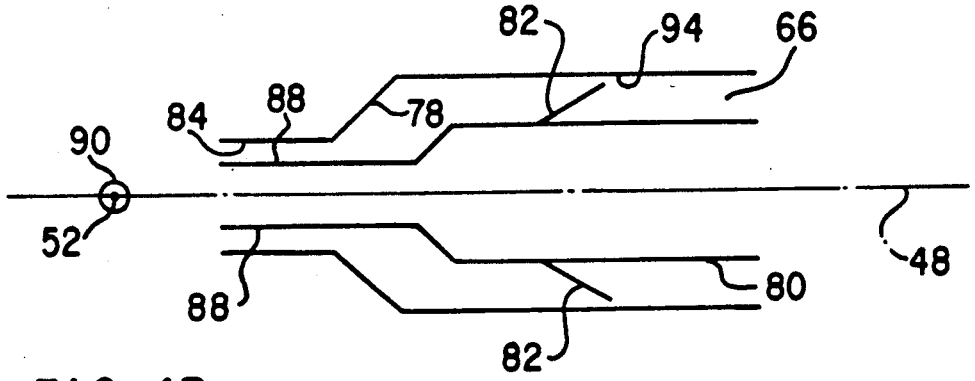
FIG. 4B is a schematic view of the elements of FIG. 4A.
Figure 4A:
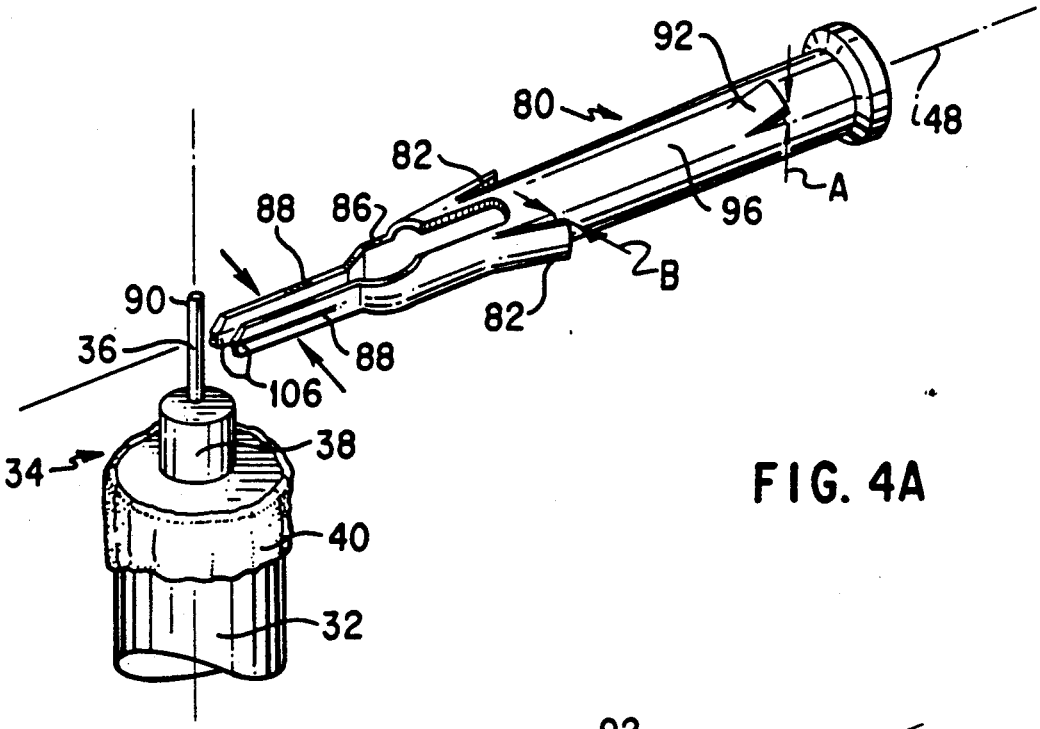
FIG. 4A is an elevational view of some of the components of FIG. 2.

In the embodiment depicted in the drawings, a female ferrule 80 is initially inserted into first elongated portion 46 as depicted in FIG. 2. FIGS. 4A and 4B represent the portion of ferrule 80 relative to cable 32 as depicted in FIG. 2. Such insertion of ferrule 80 is continued until ferrule 80 has been inserted as depicted in FIG. 3. FIGS. 5A and 5B represent the position of ferrule 80 relative to cable 32 as depicted in FIG. 3. During such continued insertion, camming tabs 82 engage camming surface 78 and then enter the second bore length 74 of bore 66. Such continued insertion cams tabs 82 toward axis 48. Since fingers 88 are integral with camming tabs 82, as best seen in FIGS. 4 and 5, the movement of camming tabs 82 toward axis 48 will cause fingers 88 to be urged inward in the direction of arrows 110 depicted in FIG. 5 such that opposing elongated protuberances 106 of opposing fingers 88 are urged toward axes 48 and 52 into engagement with outer surface 90 of the inner lead 36. In other words, upon completion of insertion of ferrule 80 as depicted in FIGS. 3 and 5B, camming tabs 82 will be biased away from axis 48 against an inner bore wall of the second bore length 74 of bore 66, and fingers 88 will extend into the second longitudinal bore 68 and be biased toward axis 52 against outer surface 90 of inner lead 36 to effect an electrical and mechanical connection thereto. During such inserting step, the retaining tabs 92 will engage inner bore wall 94 of the first bore length 70 of bore 66 as depicted in FIG. 3. Retaining tabs 92 will be biased away from axis 48 against inner bore wall 94 to effect a mechanical connection between the ferrule 80 and bushing 58 which is attached to housing 44. To complete the assembly, wings 102 and 104 are wrapped partially around cable 32 to provide integral strain relief to cable 32 vis-a-vis the connector 30.

The embodiments which have been described herein are but some of several which utilize this invention and are set forth here by way of illustration but not of limitation. It is apparent that many other embodiments which will be readily apparent to those skilled in the art may be made without departing materially from the spirit and scope of this invention.

I claim:

1. A shielded coaxial cable having a connector mechanically and electrically attached thereto comprising:

a metal connector housing having a first elongated portion extending along a first longitudinal axis and a second elongated portion extending along a second longitudinal axis which is disposed at an angle relative to said first longitudinal axis;

a plastic bushing internal of said first elongated portion and attached to said housing, said bushing having a first longitudinal bore extending along said first longitudinal axis and a second longitudinal bore extending along said second longitudinal axis, said first longitudinal bore extending to said second longitudinal bore;

a shielded coaxial cable having an end extending into said second elongated portion, an exposed length of an inner lead and an exposed length of an inner lead insulator extending from said end along said second longitudinal axis and into said second longitudinal bore, said end having a shield layer folded back upon an outer surface of said shielded coaxial cable between said outer surface and an inner surface of said second elongated portion; and, a tubular ferrule having a first portion extending into said first longitudinal bore and including at least two camming tabs which are biased away from said first longitudinal axis against an inner bore wall of said first longitudinal bore, and a second portion extending into said second longitudinal bore including at least two fingers which are biased toward said second longitudinal axis against an outer surface of said inner lead.

2. The shielded coaxial cable of claim 1 wherein said tubular ferrule further includes at least two retaining tabs which are biased away from said first longitudinal axis against an inner bore wall of said first longitudinal bore.

3. The shielded coaxial cable of claim 1 wherein each finger of said at least two fingers includes an elongated protuberance facing said first longitudinal axis, each elongated protuberance being biased toward said second longitudinal axis against said outer surface of said inner lead.

4. The shielded coaxial cable of claim 1 wherein said elongated metal tubular connector housing further includes at least one ribbed portion expanded away from an outer surface of said housing.

5. The shielded coaxial cable of claim 1 wherein said second longitudinal axis is disposed at an angle of 90° relative to said first longitudinal axis.

6. The shielded coaxial cable of claim 1 wherein said first longitudinal bore includes a first bore length adjacent a first end of said first longitudinal bore and a second bore length adjacent an opposite second end of said first longitudinal bore, said first bore length having a diameter which is greater than the diameter of said second bore length and extending to said second bore length to form a camming surface adjacent said second bore length.

7. The shielded coaxial cable of claim 6 wherein said tubular ferrule further includes at least two retaining tabs which are biased away from said first longitudinal axis against an inner bore wall of said first longitudinal bore.

8. The shielded coaxial cable of claim 7 wherein each retaining tab is biased away from said first longitudinal axis against an inner bore wall of said first bore length and further wherein each camming tab is biased away from said first longitudinal axis against an inner bore wall of said second bore length.

9. The shielded coaxial cable of claim 8 wherein each tab is integral with said tubular ferrule and protrudes at an angle away from an axis of said tubular ferrule and away from said second portion of said tubular ferrule.

10. The shielded coaxial cable of claim 9 wherein said first elongated portion of said housing includes a flanged end portion, said plastic bushing being held in place between said flanged end portion and said second elongated portion of said housing.

11. The shielded coaxial cable of claim 10 wherein said second elongated portion of said housing includes a strain relief member extending therefrom and attached to said shielded coaxial cable.

12. The shielded coaxial cable of claim 11 wherein each finger of said at least two fingers includes an elongated protuberance facing said first longitudinal axis, each elongated protuberance being biased toward said second longitudinal axis against said outer surface of said inner lead.

13. The shielded coaxial cable of claim 12 wherein said tubular ferrule is a male ferrule.

14. The shielded coaxial cable of claim 12 wherein said tubular ferrule is a female ferrule.

15. The connector of claim 1 wherein said first longitudinal bore includes a first bore length adjacent a first end of said first longitudinal bore and a second bore length adjacent an opposite second end of said first longitudinal bore, said first bore length having a diameter which is greater than the diameter of said second bore length and extending to said second bore length to form a camming surface adjacent said second bore length.

16. The connector of claim 15 wherein said tubular ferrule further includes at least two retaining tabs which will be biased away from said first longitudinal axis against an inner bore wall of said first longitudinal bore during said insertion.

17. The shielded coaxial cable of claim 16 wherein during said insertion each retaining tab will be biased away from said first longitudinal axis against an inner bore wall of said first bore length and each camming tab will be biased away from said first longitudinal axis against an inner bore wall of said second bore length.

18. The shielded coaxial cable of claim 17 wherein each tab is integral with said tubular ferrule and protrudes at an angle away from an axis of said tubular ferrule and away from said second portion of said tubular ferrule.

19. The shielded coaxial cable of claim 18 wherein said first elongated portion of said housing includes a flanged end portion, said plastic bushing being held in place between said flanged end portion and said second elongated portion of said housing.

20. The shielded coaxial cable of claim 19 wherein said second elongated portion of said housing includes a strain relief member extending therefrom and for attachment to said shielded coaxial cable.

21. The shielded coaxial cable of claim 20 wherein each finger of said at least two fingers includes an elongated protuberance which during said insertion will be biased toward said second longitudinal axis against said outer surface of said inner lead.

22. The shielded coaxial cable of claim 21 wherein said tubular ferrule is a male ferrule.

23. The shielded coaxial cable of claim 21 wherein said tubular ferrule is a female ferrule.

24. A connector for electrical and mechanical connection to a shielded coaxial cable which has an end portion including an exposed length of an inner lead and an exposed length of an inner lead insulator extending from said end portion and a shield layer folded back upon an outer surface of said shielded coaxial cable, said connector comprising:

a metal connector housing having a first elongated portion extending along a first longitudinal axis and a second elongated portion extending along a second longitudinal axis which is disposed at an angle relative to said first longitudinal axis;

a plastic bushing internal of said first elongated portion and attached to said housing, said bushing having a first longitudinal bore extending along said first longitudinal axis and a second longitudinal bore extending along said second longitudinal axis, said first longitudinal bore extending to said second longitudinal bore; and a tubular ferrule having a first portion for insertion into said first longitudinal bore when connecting said shielded coaxial cable to said connector and including at least two camming tabs which will be biased away from said first longitudinal axis against an inner bore wall of said first longitudinal bore during said insertion and a second portion for insertion into said second longitudinal bore when connecting said shielded coaxial cable to said connector including at least two fingers which will be biased toward said second longitudinal axis against an outer surface of said inner lead during said insertion.

25. The connection of claim 24 wherein said tubular ferrule further includes at least two retaining tabs which will be biased away from said first longitudinal axis against an inner bore wall of said first longitudinal bore during said insertion.

26. The shielded coaxial cable of claim 24 wherein each finger of said at least two fingers includes an elongated protuberance which during said insertion will be biased toward said second longitudinal axis against said outer surface of said inner lead.

27. The connector of claim 24 wherein said elongated metal tubular connector housing further includes at least one ribbed portion expanded away from an outer surface of said housing.

28. The connector of claim 24 wherein said second longitudinal axis is disposed at an angle of 90° relative to said first longitudinal axis.

* * * * *